US008157509B2

(12) United States Patent
Black et al.

(10) Patent No.: US 8,157,509 B2
(45) Date of Patent: Apr. 17, 2012

(54) METHOD, SYSTEM AND APPARATUS FOR TURBINE DIFFUSER SEALING

(75) Inventors: Kenneth Damon Black, Travelers Rest, SC (US); Scott Michael Elam, Simpsonville, SC (US); Prashant Kantappa Patil, Kundanhalli Bangalore (IN)

(73) Assignee: General Electric Company, Schenectady, NY (US)

( * ) Notice: Subject to any disclaimer, the term of this patent is extended or adjusted under 35 U.S.C. 154(b) by 1272 days.

(21) Appl. No.: 11/844,058

(22) Filed: Aug. 23, 2007

(65) Prior Publication Data

US 2009/0053046 A1 Feb. 26, 2009

(51) Int. Cl.
*F01D 25/26* (2006.01)

(52) U.S. Cl. ..... 415/138; 415/134; 415/126; 415/214.1; 60/39.5

(58) Field of Classification Search ..... 60/39.5, 60/39.83, 805, 806; 415/108, 110, 126, 127, 415/128, 134, 136, 138, 211.2, 213.1, 214.1
See application file for complete search history.

(56) References Cited

U.S. PATENT DOCUMENTS 3,125,362 A * 3/1964 Borg ..... 285/340
4,566,851 A * 1/1986 Comeau et al. ..... 415/139
4,863,345 A * 9/1989 Thompson et al. ..... 415/174.1
5,088,775 A * 2/1992 Corsmeier et al. ..... 285/374
7,793,507 B2 * 9/2010 Poccia et al. ..... 60/799
7,871,242 B2 * 1/2011 Swanson et al. ..... 415/145

* cited by examiner

*Primary Examiner* — Edward Look
*Assistant Examiner* — Ryan Ellis
(74) *Attorney, Agent, or Firm* — Cantor Colburn LLP

(57) ABSTRACT

A turbine diffuser is disclosed. The turbine diffuser includes a diffuser segment having a forward end and an aft end with a flange disposed at the aft end of the diffuser segment. The diffuser segment is joinable to an adjacent diffuser segment via the flange, which includes a seal retainer that is securedly connectable in a radial direction with a seal.

19 Claims, 6 Drawing Sheets

METHOD, SYSTEM AND APPARATUS FOR TURBINE DIFFUSER SEALING

BACKGROUND OF THE INVENTION

The present disclosure relates generally to turbine exhaust systems, and particularly to turbine exhaust diffusers.

Current gas turbine engines utilize an exhaust frame to support an exterior exhaust housing, or stator casing. The exhaust frame and exterior housing are made from structural steel, which is not capable of withstanding a temperature of turbine exhaust gases. Therefore, diffusers made from a material that is capable of withstanding the temperature of exhaust gases are utilized to shield the exhaust frame and exterior housing from exposure to the temperature of exhaust gases. Furthermore, blowers may be used to provide cool air for additional shielding of the exhaust frame from the temperature of exhaust gases. In conjunction with blowers, seals between the diffuser and the exhaust frame can be used to direct the cool air to appropriate locations and to reduce undesired leakage. Attention to control challenges that result from differential thermal expansion of the frame and the diffuser can yield complex and costly design and operational solutions. Accordingly, there is a need in the art for a turbine exhaust arrangement that overcomes these drawbacks.

BRIEF DESCRIPTION OF THE INVENTION

An embodiment of the invention includes a turbine diffuser. The turbine diffuser includes a diffuser segment having a forward end and an aft end with a flange disposed at the aft end of the diffuser segment. The diffuser segment is joinable to an adjacent diffuser segment via the flange, which includes a seal retainer that is securedly connectable in a radial direction with a seal.

Another embodiment of the invention includes a turbine exhaust system. The turbine exhaust system includes a frame, an outer stator supported by the frame, and a turbine diffuser disposed within the outer stator. The turbine diffuser includes a diffuser segment having a forward end and an aft end and a flange including a seal retainer, the flange disposed at the aft end of the diffuser segment, which is joinable to an adjacent diffuser segment via the flange. The turbine exhaust system further includes a seal having a first end and a second end. The first end of the seal is securedly connected in a radial direction with the seal retainer and the second end of the seal is securedly connected with the frame.

Another embodiment of the invention includes a method of sealing a turbine exhaust system. The method includes securedly connecting in a radial direction a first end of a seal in a seal retainer of a flange disposed at an aft end of a diffuser segment, the diffuser segment being joinable to an adjacent diffuser segment via the flange. The method further includes securedly connecting a second end of the seal to a frame supporting an outer stator of the exhaust system.

These and other advantages and features will be more readily understood from the following detailed description of preferred embodiments of the invention that is provided in connection with the accompanying drawings.

BRIEF DESCRIPTION OF THE DRAWINGS

Referring to the exemplary drawings wherein like elements are numbered alike in the accompanying Figures.

DETAILED DESCRIPTION OF THE INVENTION

An embodiment of the invention provides a turbine diffuser arrangement that includes a connection flange incorporating a seal retainer. A seal disposed between the exhaust frame and the seal retainer directs and reduces undesired loss of cooling air. In an embodiment, thermal expansion of the diffuser relative to the exhaust frame results in a reduced thermal contact area between the seal and the retainer, thereby reducing a transfer of heat therebetween.

Figure 1:
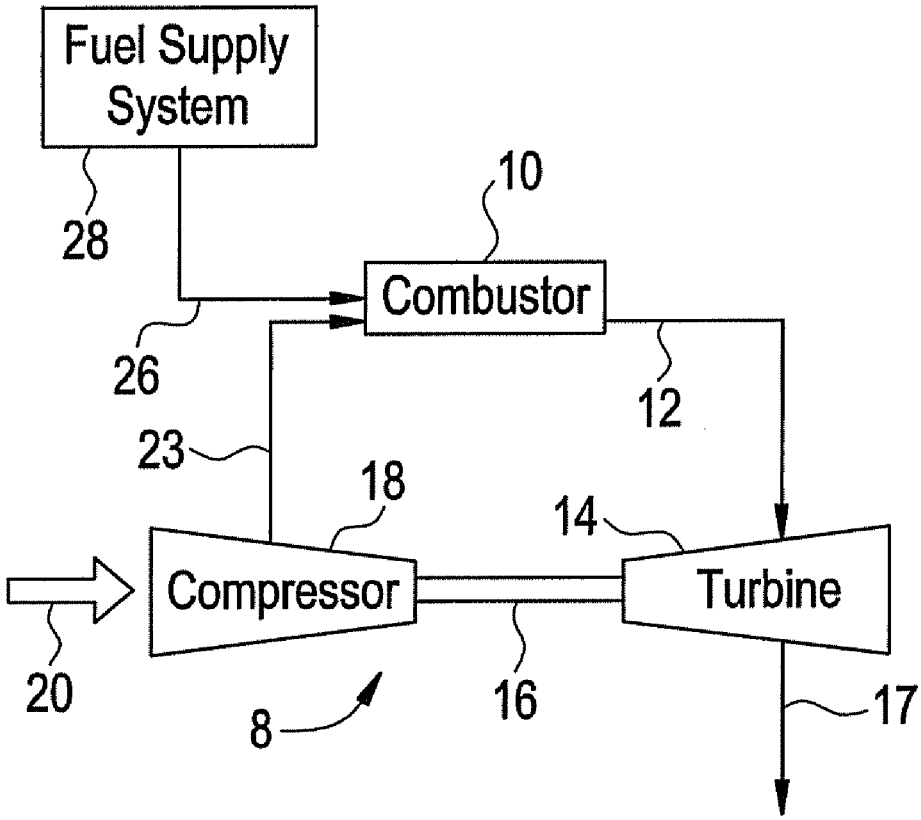
FIG. 1 depicts a schematic drawing of a turbine engine in accordance with an embodiment of the invention.

FIG. 1 depicts a schematic drawing of an embodiment of a turbine engine 8, such as a gas turbine engine 8. The gas turbine engine 8 includes a combustor 10. Combustor 10 burns a fuel-oxidant mixture to produce a flow of gas 12 which is hot and energetic. The flow of gas 12 from the combustor 10 then travels to a turbine 14. The turbine 14 includes an assembly of turbine blades (not shown). The flow of gas 12 imparts energy on the assembly of turbine blades causing the assembly of turbine blades to rotate. The assembly of turbine blades is coupled to a shaft 16. The shaft 16 rotates in response to a rotation of the assembly of turbine blades. The shaft 16 is then used to power a compressor 18. The shaft 16 can optionally provide a power output 17 to a different output device (not shown), such as, for example, an electrical generator. The compressor 18 takes in and compresses an oxidant stream 20. Following compression of the oxidant stream 20, a compressed oxidant stream 23 is fed into the combustor 10. The compressed oxidant stream 23 from the compressor 18 is mixed with a fuel flow 26 from a fuel supply system 28 to form the fuel-oxidant mixture inside the combustor 10. The fuel-oxidant mixture then undergoes a burning process in the combustor 10.

Figure 2:
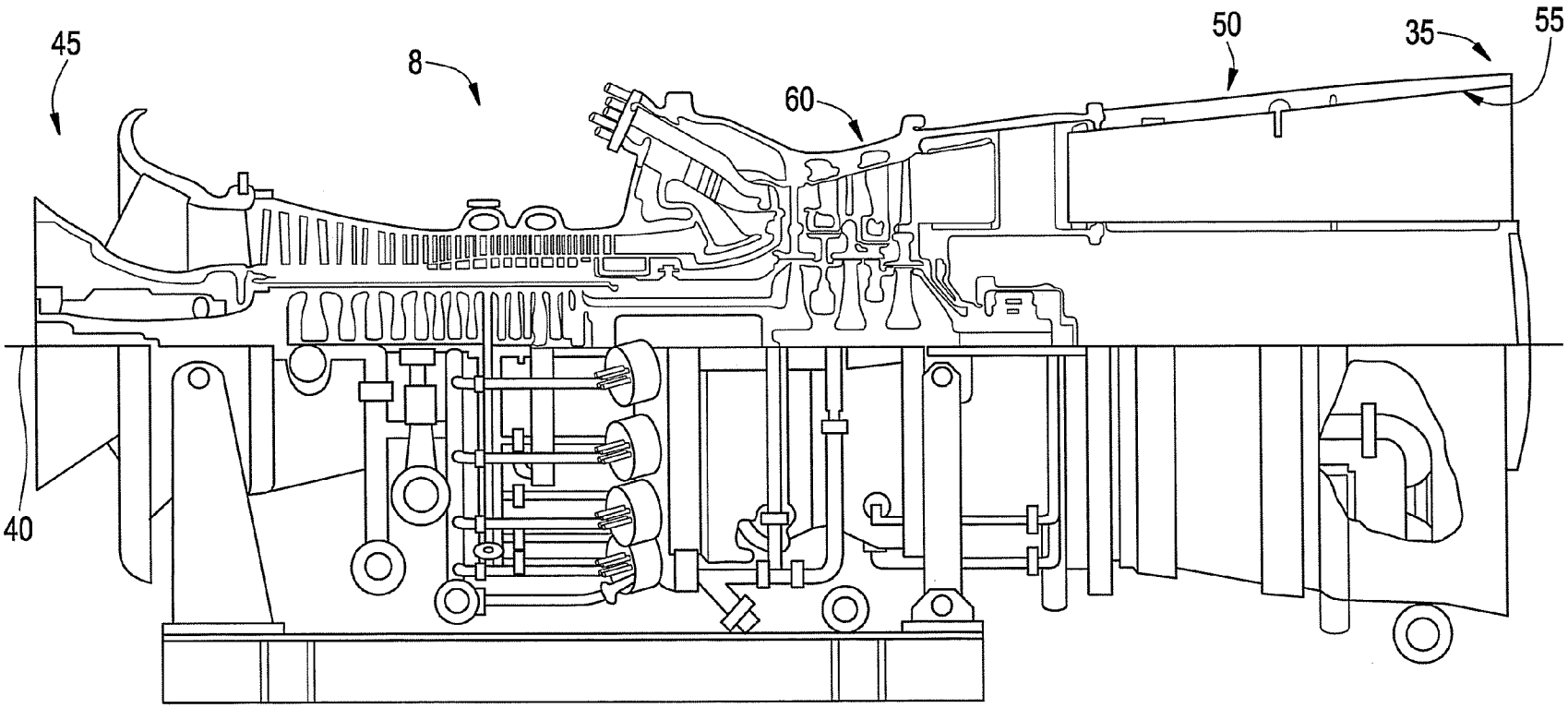
FIG. 2 depicts a partial cutaway side view of a turbine engine in accordance with an embodiment of the invention.

FIG. 2 depicts an embodiment of the turbine engine 8. The turbine engine 8 includes an exhaust section 50 (also herein referred to as an "exhaust system"). The exhaust section 50 includes a diffuser 55 (also herein referred to as a "turbine diffuser") disposed radially inboard of a frame 65 (best seen with reference to FIG. 3 and also herein referred to as an "exhaust frame") of the exhaust section 50. The diffuser 55 is made of a material, such as stainless steel for example, that is capable to withstand temperatures of hot exhaust gases, and therefore shields the frame 65, which is made from materials that are not capable to withstand hot exhaust gas temperatures.

As used herein to describe relative position, the term "aft" shall refer to a relative position that is downstream, or located toward an exit end 35 along an axial centerline 40 of the turbine engine 8. As used herein to describe relative position, the term "forward" shall refer to a relative position that is upstream, or located toward an inlet end 45 along the axial centerline 40 of the turbine engine 8.

Figure 3:
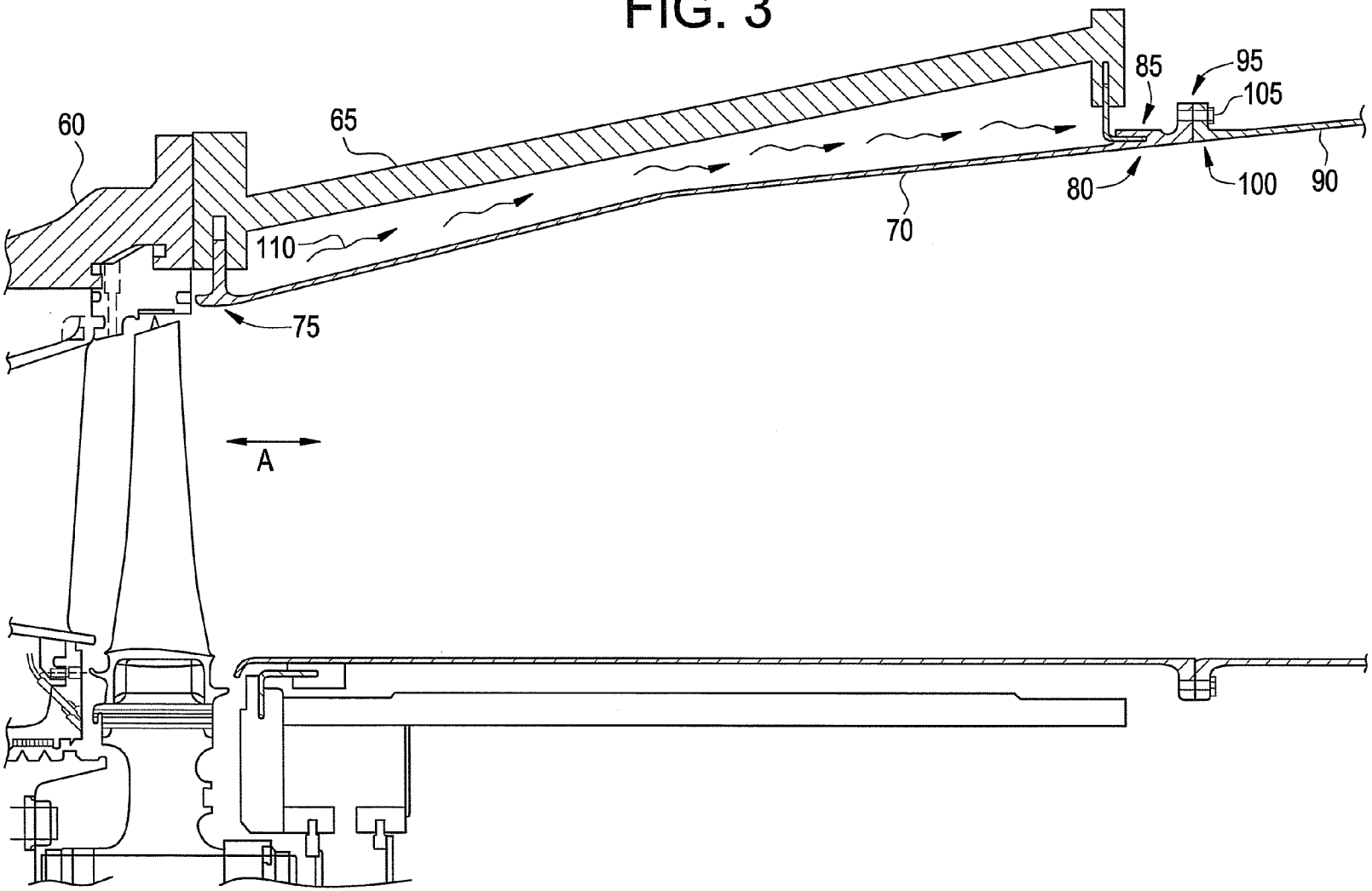
FIG. 3 depicts an enlarged cross section of an exhaust section of the turbine engine in FIG. 2 in accordance with an embodiment of the invention.

FIG. 3 depicts an enlarged cross-section view of the exhaust section 50. The frame 65 supports an aft end of a stator casing 60 (also referred to herein as an "outer stator"). The diffuser 55 includes a diffuser segment 70 (also herein referred to as a "forward diffuser segment") which includes a forward end 75 and an aft end 80. The forward diffuser segment 70 further includes a flange 85 (also herein referred to as a "first flange"), such as a vertical flange for example, disposed at the aft end 80 of the diffuser segment 70. The forward diffuser segment 70 is joinable to an adjacent diffuser segment 90 (also herein referred to as an "aft diffuser segment") via the flange 85. In an embodiment, the aft diffuser segment 90 includes a flange 95 (also herein referred to as a "second flange"), such as a vertical flange for example, disposed at a forward end 100 of the aft diffuser segment 90, and the forward diffuser segment 70 is joined to the aft diffuser segment 90 via connection of the first flange 85 to the second flange 95. In an embodiment, the first flange 85 is connected to the second flange 95 via a fastener 105, such as a bolt or a clamp for example, connecting the first flange 85 to the second flange 95. It is further contemplated that additional arrangements to connect the first flange 85 to the second flange 95 may be utilized, such as welding, brazing, and riveting for example. Cooling air 110, (schematically represented by wavy lines) is provided by a compressor or blower (not shown) and circulated between the diffuser 55 and frame 65 to reduce transmission of heat from the diffuser 55 to the frame 65. Increased consumption of the cooling air 110, resulting from unintended leakage or escape, results in increased blower capacity requirements and power consumption, which thereby reduces a total operational efficiency of the turbine engine 8.

Figure 4:
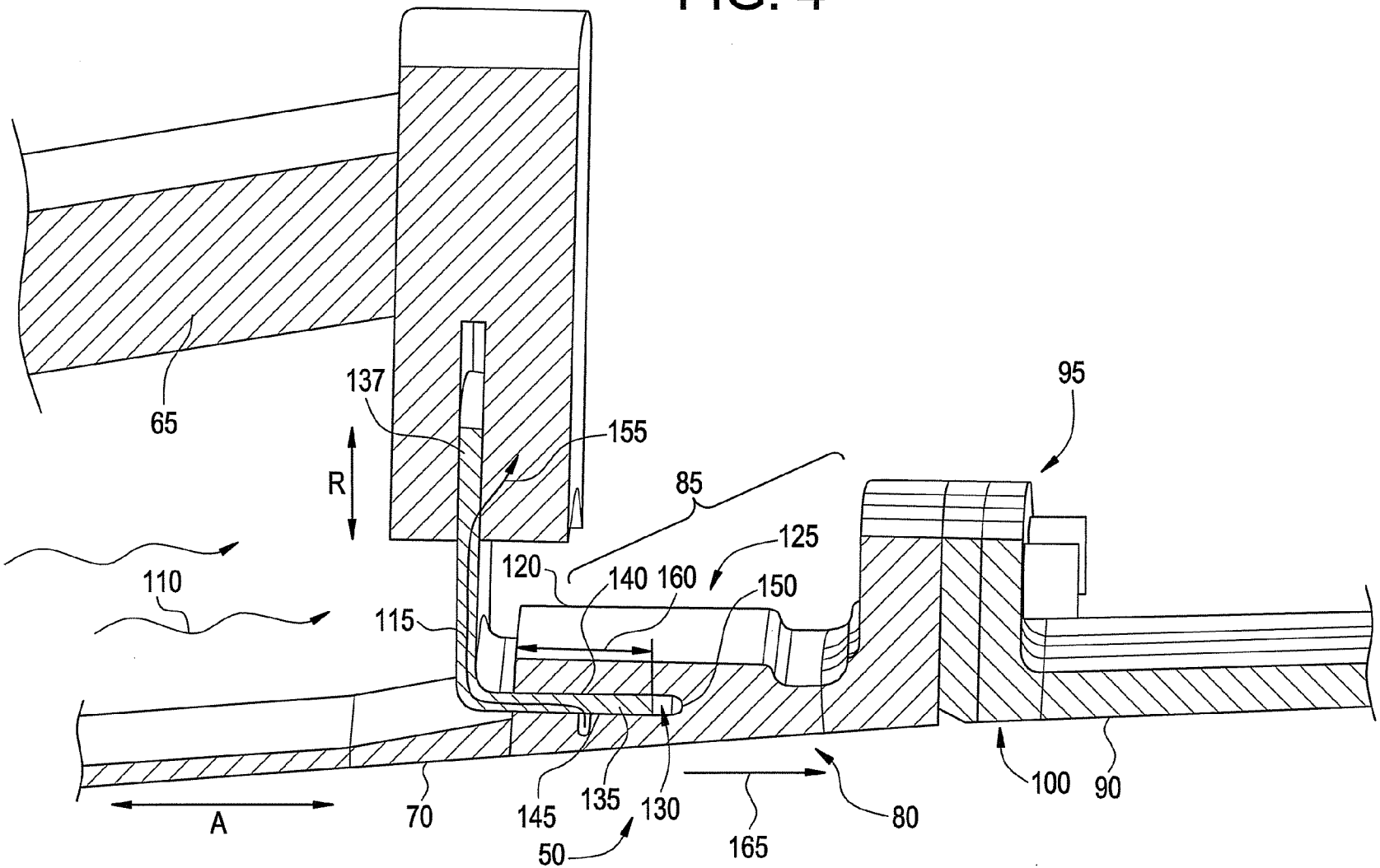
FIG. 4 depicts an enlarged cross section of the exhaust section of FIG. 3 in accordance with an embodiment of the invention.

Referring now to FIG. 4, an enlarged cross section of the exhaust system 50 is depicted. A seal 115 is disposed between the diffuser segment 70 and the frame 65 to reduce unintended escape of the cooling air 110 from between the diffuser segment 70 and the frame 65. In an embodiment, the seal 115 is made from an appropriate metal to withstand the ambient temperatures to which the seal 115 is exposed. The flange 85 disposed at the aft end 80 of the forward diffuser segment 70 includes a seal retainer 120 disposed at a forward end 125 of the flange 85. The seal retainer 120 is securedly connectable in a radial direction, R with the seal 115, and thereby secures or constrains displacement of a first end 135 of the seal 115, such as displacement in the radial direction R, for example. A second end 137 of the seal 115 is disposed within the frame 65.

In one embodiment, the first end 135 of the seal 115 is oriented axially (aligned with an axial direction A) facing toward the aft end 80 of the diffuser segment 70, and the second end 137 of the seal 115 is oriented radially (aligned with the radial direction R) facing outward, toward the frame 65.

The seal retainer 120 includes an opening 130 that faces the forward end 75 of the diffuser segment 70 (also herein referred to as a "forward facing opening"). In one embodiment, the forward facing opening 130 is an axial opening. The first end 135 of the seal 115 is disposed in the forward facing opening 130. In an embodiment, the forward facing opening 130 includes three sides 140, 145, 150, which define for example, the forward facing opening 130 as a forward facing slot 130. The seal retainer 120 is securedly connectable with the seal 115 and secures or constrains displacement of the seal 115 in the radial direction R. The forward facing opening 130 provides a degree of freedom between the seal 115 and the seal retainer 120 in the axial direction A, which is generally aligned with the axial centerline 40 of the turbine engine 8 (best seen with reference to FIG. 2). Subsequent to disposal of the first end 135 of the seal 115 within the opening 130, the degree of freedom between the first end 135 of the seal 115 and the seal retainer 120 allows relative motion in the axial direction A between the seal 115 and the seal retainer 120, while preventing or constraining motion between the first end 135 of the seal 115 and the seal retainer 120 in the radial direction R.

Referring now to FIG. 3 in conjunction with FIG. 4, an embodiment provides the forward end 75 of the forward diffuser segment 70 supported by the frame 65, such that the forward end 75 is restrained from movement relative to the frame 65 in the axial direction A. The aft end 80 of the forward diffuser segment 70 includes a degree of freedom relative to the frame 65 such that displacement of the aft end 80 in the axial direction A relative to the frame 65 is unrestrained.

As described above, it desirable to reduce a flow of heat from the exhaust gases to the exhaust frame 65, as the exhaust frame 65 is made from material that is not well suited to exposure to turbine exhaust gas temperatures. Therefore, particularly during starting of the turbine engine 8, there are differential thermal expansions of the diffuser 55 (exposed to the temperature of turbine exhaust gases) relative to the exhaust frame 65, which is shielded by the diffuser 55 from exposure to the temperature of the turbine exhaust gases. A heat conduction path 155 depicts an example of heat transfer from the diffuser segment 70 through the seal retainer 120 of the flange 85, into the seal 115, and to the frame 65. A length of axial overlap 160 defines an area of contact between the first end 135 of the seal 115 and the seal retainer 120. The area of contact provides a thermal contact area, such that the greater the length of overlap 160, the greater the amount of heat that may be transferred via the heat conduction path 155 from the diffuser segment 70 to the frame 65 at a given temperature of the diffuser segment 70.

As a result of thermal expansion from exposure to the temperature of the turbine exhaust gases, the aft end 80 of the diffuser segment 70 is responsive to an increasing temperature of the diffuser segment 70 to translate in an aft direction 165 relative to the exhaust frame 65. Therefore, because of the axial degree of freedom between the seal 115 and the seal retainer 120, the seal retainer 120 is responsive to the aft translation of the aft end 80 of the diffuser segment 70 to translate aft in an axial direction relative to the seal 115. Aft translation of the seal retainer 120 relative to the seal 115 results in partial disengagement of the first end 135 of the seal 115 within the seal retainer 120 opening 130, thereby reducing the length of overlap 160, and the thermal contact area between the first end 135 of the seal 115 and the seal retainer 120. Accordingly, reducing the thermal contact area in response to the increasing temperature of the diffuser segment 70 reduces the amount of heat transferred by the heat conduction path 155 at a given temperature. For example, as the temperature of the diffuser segment 70 increases and the seal retainer 120 partially disengages from the first end 135 of the seal 115, the amount of heat transferred from the diffuser segment 70 to the exhaust frame 65 via the seal 115 is less than that in the absence of the response of the diffuser segment 70 and seal retainer 120 to the increasing temperature of the diffuser segment 70.

Figure 5:
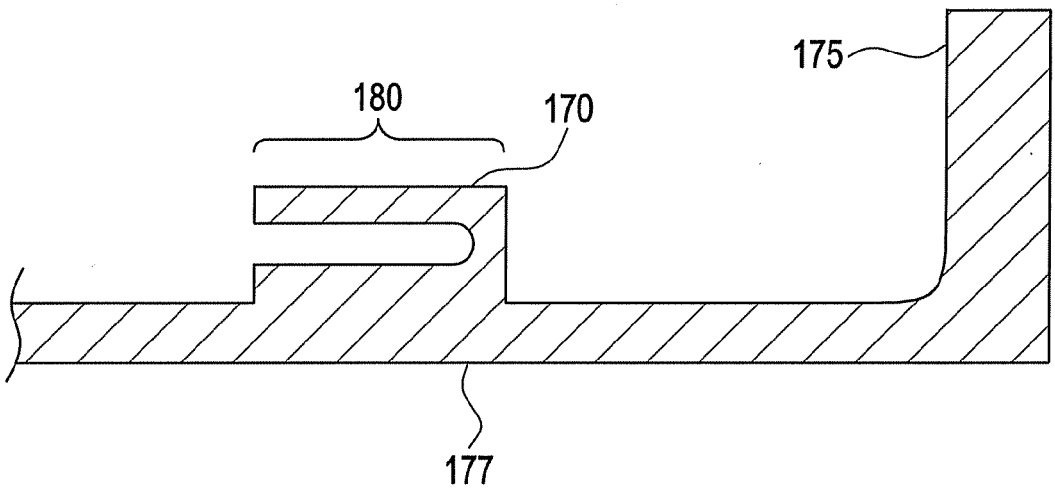
FIG. 5 depicts an enlarged cross section of an exhaust section of a turbine diffuser.

With reference to FIG. 4 in conjunction with FIG. 5, incorporation of the seal retainer 120 within the flange 85 reduces a mass gradient disturbance 180 between the diffuser segment 70 and the seal retainer 120 as compared to use of a separate seal retainer 170 and flange 175 disposed upon a diffuser segment 177. The reduced mass gradient disturbance 180 provides a reduction of transient stresses and displacements, which are generally undesirable. Accordingly, the diffuser segment 70 having the flange 85 that includes the seal retainer 120 results in a reduction of transient stresses and displacements as compared to the diffuser segment 177 having the separate seal retainer 170. Therefore, the reduced mass gradient disturbance 180 resulting from integration of the seal retainer 120 with the flange 85 provides a benefit of a reduction in development of transient state stress and displacement, in addition to the convenience of location of the separate seal retainer 170 proximate the flange 175.

Figure 6:
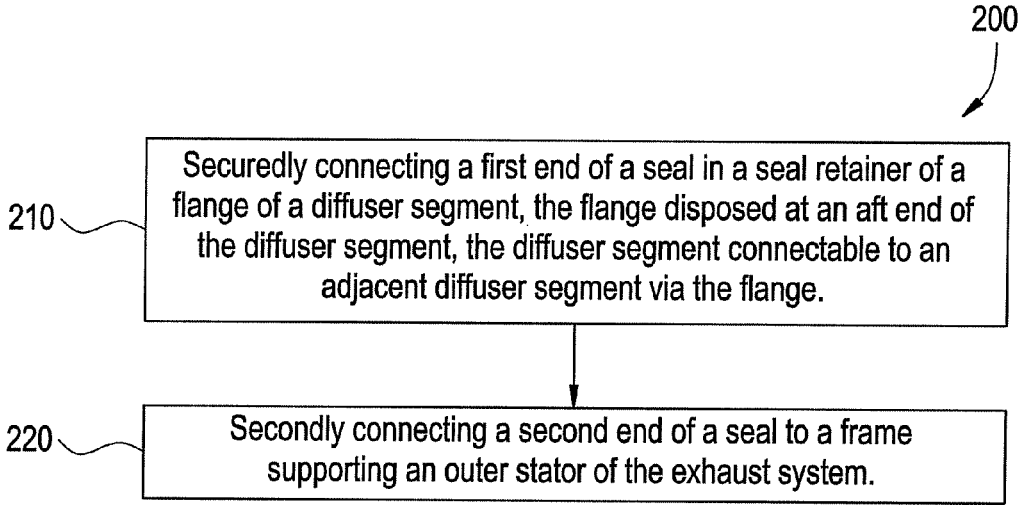
FIG. 6 depicts a flowchart of process steps of a method for sealing a diffuser segment in accordance with an embodiment of the invention.

In view of the foregoing, the turbine exhaust system 50 facilitates a method of sealing the diffuser segment 70 to the exhaust frame 65. Referring now to FIG. 6, in conjunction with FIGS. 3 and 4, a flowchart 200 of process steps for sealing a diffuser segment, such as the diffuser segment 70 to an exhaust frame, such as the exhaust frame 65 is depicted.

In an embodiment, the method begins at Step 210 by securedly connecting the first end 135 of the seal 115 in the seal retainer 120 of the flange 85 of the diffuser segment, 70 which is disposed at the aft end 80 of the diffuser segment 70. The diffuser segment 70 is connectable to the adjacent diffuser segment 90 via the flange 85. An embodiment of the method concludes at Step 220 with securedly connecting the second end 137 of the seal 115 to the frame 65, which supports the stator casing 60 (best seen with reference to FIG. 2) of the exhaust system 50.

In an embodiment of the method, the securedly connecting the first end 135 of the seal 115, at Step 210, includes disposing the first end 135 of the seal 115 in the forward facing slot 130 of the seal retainer 120. An embodiment of the method further includes translating the aft end 80 of the diffuser segment 70 in an aft direction relative to the frame 65 in response to increasing temperature of the diffuser segment 70. Further, in response to the aft translation of the aft end 80 of the diffuser segment 70, the method includes reducing the length of overlap 160 that defines the thermal contact area between the first end 135 of the seal 115 and the seal retainer 120, thereby reducing an amount of heat transferred from the diffuser segment 70 to the exhaust frame 65 via the heat conduction path 155 of the seal 115.

An embodiment of the method provides securedly connecting, at Step 210, the first end 135 of the seal 115 oriented axially toward the aft end 80 of the diffuser segment 70 with the seal retainer 120 and securedly connecting, at Step 220, the second end 137 of the seal 115 oriented radially outward, toward the frame 65 with the frame 65.

As disclosed, some embodiments of the invention may include some of the following advantages: reducing cooling blower capacity requirements by reducing unintended cooling air leakage; reducing a thermal contact area of a seal in response to increasing diffuser temperature via a responsive sealing arrangement; and reducing transient thermal stresses and displacements associated with a seal retainer disposed proximate a bolted vertical flange by incorporating the seal retainer into the flange.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A turbine diffuser comprising:
a diffuser segment having a forward end and an aft end; and
a flange disposed at the aft end of the diffuser segment, the diffuser segment joinable to an adjacent diffuser segment via the flange;
wherein the flange comprises a seal retainer comprising an opening facing the forward end of the diffuser segment securedly connectable in a radial direction with a seal.

2. The turbine diffuser of claim 1, wherein the opening comprises three sides.

3. The turbine diffuser of claim 1, wherein the opening comprises a slot.

4. The turbine diffuser of claim 1, wherein the seal retainer is disposed at a forward end of the flange.

5. The turbine diffuser of claim 1, wherein the seal retainer is securedly connectable in the radial direction with the seal comprising an axial degree of freedom therebetween.

6. A turbine exhaust system comprising:
a frame;
an outer stator supported by the frame;
a turbine diffuser disposed within the outer stator, the turbine diffuser comprising:
a diffuser segment having a forward end and an aft end;
a flange disposed at the aft end of the diffuser segment, the diffuser segment joinable to an adjacent diffuser segment via the flange, the flange comprising a seal retainer; and
a seal having a first end and a second end, the first end of the seal securedly connected in a radial direction with the seal retainer and the second end of the seal securedly connected with the frame.

7. The turbine exhaust system of claim 6, wherein the diffuser segment is a forward diffuser segment and the flange is a first flange, further wherein:
the adjacent diffuser segment is an aft diffuser segment comprising a second flange disposed at a forward end of the aft diffuser segment; and
the forward diffuser segment is joined to the aft diffuser segment via the first flange and the second flange.

8. The turbine exhaust system of claim 6, wherein the seal retainer comprises an opening facing the forward end of the diffuser segment.

9. The turbine exhaust system of claim 8, wherein the opening comprises three sides.

10. The turbine exhaust system of claim 8, wherein the opening comprises a slot.

11. The turbine exhaust system of claim 6, wherein the seal retainer is disposed at a forward end of the flange.

12. The turbine exhaust system of claim 6, wherein the first end of the seal is securedly connected in the radial direction with the seal retainer comprising an axial degree of freedom therebetween.

13. The turbine exhaust system of claim 6, wherein:
the diffuser segment is supported by the frame at the forward end of the diffuser segment; and the aft end of the diffuser segment and the frame have a degree of freedom therebetween.

14. The turbine exhaust system of claim 13, wherein:

the aft end of the diffuser segment is responsive to increasing temperature of the diffuser segment to translate in an axial direction relative to the frame; and the seal retainer is responsive to the axial translation of the aft end of the diffuser segment to reduce a length of axial overlap between the first end of the seal and the seal retainer.

15. The turbine exhaust system of claim 6, wherein:

the first end of the seal is oriented axially toward the aft end of the diffuser segment; and the second end of the seal is oriented radially toward the frame.

16. A method of sealing a turbine exhaust system comprising:

securedly connecting in a radial direction a first end of a seal in a seal retainer of a flange of a diffuser segment, the flange being disposed at an aft end of the diffuser segment, the diffuser segment being joinable to an adjacent diffuser segment via the flange; and securedly connecting a second end of the seal to a frame supporting an outer stator of the exhaust system.

17. The method of claim 16, wherein the securedly connecting a first end of the seal comprises:

disposing the first end of the seal in a forward facing slot of the seal retainer.

18. The method of claim 16, further comprising:

in response to increasing temperature of the diffuser segment, translating the aft end of the diffuser segment in an axial direction relative to the frame; and in response to the axial translation of the aft end of the diffuser segment, reducing a length of axial overlap between the first end of the seal and the seal retainer.

19. The method of claim 16, wherein:

the securedly connecting in the radial direction a first end of a seal comprises securedly connecting the first end of the seal oriented axially toward the aft end of the diffuser segment; and the securedly connecting a second end of a seal comprises securedly connecting the second end of the seal oriented radially toward the frame.

* * * * *